US009694607B2

(12) United States Patent
Ogawa et al.

(10) Patent No.: US 9,694,607 B2
(45) Date of Patent: Jul. 4, 2017

(54) SHEET-LIKE MEMBER HOLDING DEVICE OF PRINTING PRESS

(71) Applicant: Komori Corporation, Tokyo (JP)

(72) Inventors: Naoki Ogawa, Tsukuba (JP); Satoshi Inose, Tsukuba (JP)

(73) Assignee: KOMORI CORPORATION, Tokyo (JP)

( * ) Notice: Subject to any disclaimer, the term of this patent is extended or adjusted under 35 U.S.C. 154(b) by 0 days.

(21) Appl. No.: 15/171,583

(22) Filed: Jun. 2, 2016

(65) Prior Publication Data

US 2016/0355034 A1 Dec. 8, 2016

(30) Foreign Application Priority Data

Jun. 5, 2015 (JP) ..... 2015-114516
May 20, 2016 (JP) ..... 2016-101138

(51) Int. Cl.

| | |
|---|---|
| ***B41J 2/01*** | (2006.01) |
| ***B41J 11/58*** | (2006.01) |
| ***B41F 30/04*** | (2006.01) |
| ***B41F 30/02*** | (2006.01) |
| ***B41J 13/22*** | (2006.01) |

(52) U.S. Cl.

CPC ..... *B41J 11/58* (2013.01); *B41F 30/02* (2013.01); *B41F 30/04* (2013.01); *B41J 13/223* (2013.01)

(58) Field of Classification Search

CPC combination set(s) only.
See application file for complete search history.

(56) References Cited

U.S. PATENT DOCUMENTS 3,007,408 A * 11/1961 Taylor ..... B41F 21/04 101/409
4,367,679 A * 1/1983 Ishii ..... B41F 21/10 101/410
5,673,624 A * 10/1997 Grundke ..... B41F 30/00 101/415.1

FOREIGN PATENT DOCUMENTS

| | | |
|---|---|---|
| DE | 44 24 930 A1 | 1/1996 |
| DE | 100 01 323 A1 | 7/2001 |
| JP | H03-286866 A | 12/1991 |
| JP | H03-286867 A | 12/1991 |

OTHER PUBLICATIONS

Search Report in European Application No. 16001264.7 dated Oct. 26, 2016. 9 pages.

* cited by examiner

*Primary Examiner* — Matthew Luu
*Assistant Examiner* — Tracey McMillion
(74) *Attorney, Agent, or Firm* — Blakely Sokoloff Taylor & Zafman LLP

(57) ABSTRACT

A sheet-like member holding device includes a first holding unit disposed between a gripper receiving portion and a side wall of a gap, and configured to hold a base of a non-metal sheet. The first holding unit includes a space in which the base is inserted while the non-metal sheet extends inward in a radial direction from an outer surface side of a printing cylinder, and an abutment wall configured to restrict movement of the base to the outside in the radial direction. An end portion of the space in an axial direction of the printing cylinder is open to the outside. This makes it possible to attach and detach the non-metal sheet by a simple method without moving a gripper member or gripper pad.

6 Claims, 6 Drawing Sheets

SHEET-LIKE MEMBER HOLDING DEVICE OF PRINTING PRESS

BACKGROUND OF THE INVENTION

The present invention relates to the sheet-like member holding device of a printing press for holding a sheet-like member disposed on the outer surface of the cylinder of the printing press.

Conventionally, a sheet-like member is often attached to the surface of a printing cylinder, as disclosed in Japanese Patent Laid-Open Nos. 3-286866 (literature 1) and 3-286867 (literature 2). The sheet-like member disclosed in literatures 1 and 2 is a protection sheet. This protection sheet covers a sheet support portion for supporting a sheet on the printing cylinder. The protection sheet disclosed in literatures 1 and 2 is fixed to the printing cylinder by a protection sheet holding device.

The protection sheet holding device disclosed in literatures 1 and 2 is disposed in an gap formed in an outer surface of the printing cylinder. A gripper device for gripping and holding a sheet is disposed in the gap. The gripper device sandwiches and holds a sheet by a gripper and a gripper pad. The protection sheet holding device adopts an arrangement of holding one end portion of the protection sheet using a sheet holding member disposed inside the gripper pad of the gripper device in the radial direction of the printing cylinder. The other end portion of the protection sheet is wound around a sheet holding shaft disposed in the gap, and held.

The above-described sheet holding member is disposed at a position opposing a side wall extending in the radial direction of the printing cylinder in the gap to be movable forward and backward, and sandwiches one end portion of the protection sheet in cooperation with the side wall. The gripper pad is configured to contact or be separated from the above-described side wall. When making the sheet holding member hold one end portion of the protection sheet, the gripper pad is separated from the side wall to form, between the gripper pad and the side wall, a space through which the protection sheet passes. When the gripper pad moves, the gripper swings to a release position to avoid interference with the gripper pad.

As described above, in the protection sheet holding device disclosed in literatures 1 and 2, when attaching the protection sheet to the printing cylinder, it is necessary to move the gripper and the gripper pad. This operation not only imposes a load on an operator but also causes a failure of the gripper, or misregistration or a failure of the gripper pad.

SUMMARY OF THE INVENTION

It is an object of the present invention to provide the sheet-like member holding device of a printing press, which can attach and detach a sheet-like member by a simple method without moving a gripper or gripper pad.

In order to achieve the above object of the present invention, there is provided a sheet-like member holding device of a printing press, including a gripper receiving portion disposed in a gap formed in an outer surface of a cylinder, and configured to grip a sheet as a printing product together with a gripper, a first holding unit disposed between the gripper receiving portion and a side wall extending in a radiation direction of the cylinder on an upstream side in a sheet convey direction in the gap, and configured to hold one end portion of a sheet-like member overlaid on an outer surface of the cylinder, and a second holding unit configured to hold the other end portion of the sheet-like member, wherein the sheet-like member includes, in the one end portion, a locking piece formed to have a thickness larger than that of a remaining portion, the first holding unit includes a space in which the one end portion of the sheet-like member is inserted while the sheet-like member extends inward in the radial direction of the cylinder from an outer surface side of the cylinder, and an abutment wall opposing the locking piece of the one end portion inserted in the space from the outside in the radial direction of the cylinder, and configured to restrict movement of the locking piece to the outside in the radial direction, and an end portion of the space in an axial direction of the cylinder is open to the outside.

DESCRIPTION OF THE PREFERRED EMBODIMENT

Figure 1:
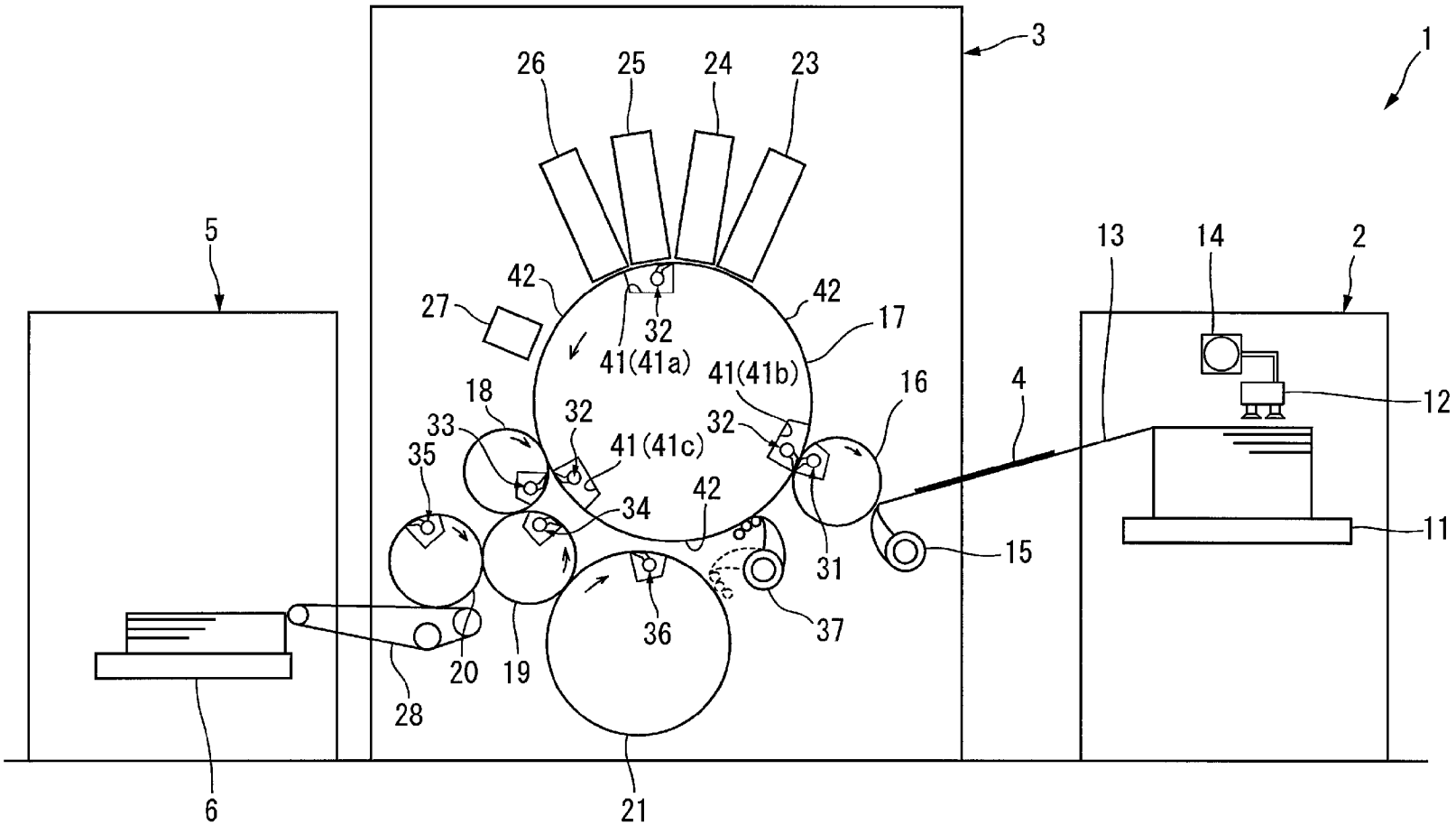
FIG. 1 is a side view showing the overall arrangement of a printing press adopting a sheet-like member holding device according to an embodiment of the present invention.

An embodiment of the sheet-like member holding device of a printing press according to the present invention will be described in detail below with reference to FIGS. 1 to 9. This embodiment will explain an example when the present invention is applied to a printing cylinder. A printing press 1 shown in FIG. 1 conveys a sheet 4 as a printing product from a feeder unit 2 positioned at the rightmost position in FIG. 1 to a printing unit 3, and the printing unit 3 prints on one or two surfaces of the sheet 4. The sheet 4 printed by the printing unit 3 is fed to a delivery unit 5, and delivered to a delivery pile 6.

The feeder unit 2 has a structure of transferring the sheet 4 from a feeder pile 11 to a feeder board 13 by a sucker 12. The sucker 12 is connected to an intermittent sheet feed valve 14, and operates in one of a mode in which the sheets 4 are successively fed and a mode in which the sheets 4 are intermittently fed. If only the obverse surface of each sheet 4 is printed, the sucker 12 successively feeds the sheets 4 to the feeder board 13. On the other hand, if the obverse and reverse surfaces of each sheet 4 are printed, the sucker 12 intermittently feeds the sheets 4 to the feeder board 13.

The printing unit 3 includes a feed-side transfer cylinder 16 to which the sheet 4 fed from the feeder unit 2 is conveyed by a sheet feed-side swing device 15, a printing cylinder 17 to which the sheet 4 is fed from the feed-side transfer cylinder 16, and a plurality of transport cylinders 18 to 21 for feeding the printed sheet 4. The feed-side transfer cylinder 16 includes a heater (not shown) for heating the sheet 4 to a predetermined temperature. The printing cylinder 17 sucks and conveys the sheet 4, and includes a sucking device 22 (see FIG. 2) (to be described later). In this embodiment, the printing cylinder 17 forms a "cylinder" according to the present invention.

The printing unit 3 further includes first to fourth inkjet heads 23 to 26 and an ink drying lamp 27, all of which oppose the printing cylinder 17. The first to fourth inkjet heads 23 to 26 are arranged on the downstream side of the feed-side transfer cylinder 16 in the sheet convey direction, and execute printing by discharging ink droplets to the sheet 4 conveyed by the printing cylinder 17. Note that the number of inkjet heads is not limited to four. The ink drying lamp 27 is arranged on the downstream side of the fourth inkjet head 26 in the convey direction, and dries (cures) printed ink which has been applied to the sheet 4 by the first to fourth inkjet heads 23 to 26.

The above-described plurality of transport cylinders include the first delivery-side transfer cylinder 18 for receiving the sheet 4 from the printing cylinder 17, the second delivery-side transfer cylinder 19 for receiving the sheet 4 from the first delivery-side transfer cylinder 18, and the third delivery-side transfer cylinder 20 and pre-converting double-size cylinder 21 for receiving the sheet 4 from the second delivery-side transfer cylinder 19. The sheet 4 whose reverse surface is printed is conveyed from the second delivery-side transfer cylinder 19 to the pre-converting double-size cylinder 21. The sheet 4 whose obverse surface is printed or the sheet 4 whose obverse and reverse surfaces are printed is fed from the second delivery-side transfer cylinder 19 to the third delivery-side transfer cylinder 20, and then fed to the delivery pile 6 via a delivery belt 28.

The feed-side transfer cylinder 16, printing cylinder 17, first delivery-side transfer cylinder 18, second delivery-side transfer cylinder 19, third delivery-side transfer cylinder 20, and pre-converting double-size cylinder 21 include gripper devices 31 to 36 for transferring the sheet 4, respectively. These gripper devices 31 to 36 have a conventionally known structure of gripping and holding the downstream end portion of the sheet 4 in the convey direction.

A convertible swing device 37 for feeding the sheet 4 from the pre-converting double-size cylinder 21 to the printing cylinder 17 is arranged between the pre-converting double-size cylinder 21 and the feed-side transfer cylinder 16. The convertible swing device 37 grips the upstream end portion of the sheet 4 in the convey direction, which has been fed by the pre-converting double-size cylinder 21, and feeds the sheet 4 to the printing cylinder 17 while the obverse surface of the sheet 4 opposes the printing cylinder 17.

The outer portion of the printing cylinder 17 is formed by three gaps 41 (41*a* to 41*c*) each accommodating the gripper device 32, and three sheet support portions 42 each for sucking and holding the sheet 4. The three gaps 41 are formed at positions spaced apart from each other in the circumferential direction in the outer surface of the printing cylinder 17. More precisely, the three gaps 41 are formed at positions which divide the outer surface into three parts in the circumferential direction. Although details will be described later, the three sheet support portions 42 are formed between the gaps 41. That is, the printing cylinder 17 is a triple-size cylinder including three pairs of gaps 41 and sheet support portions 42.

Figure 2:
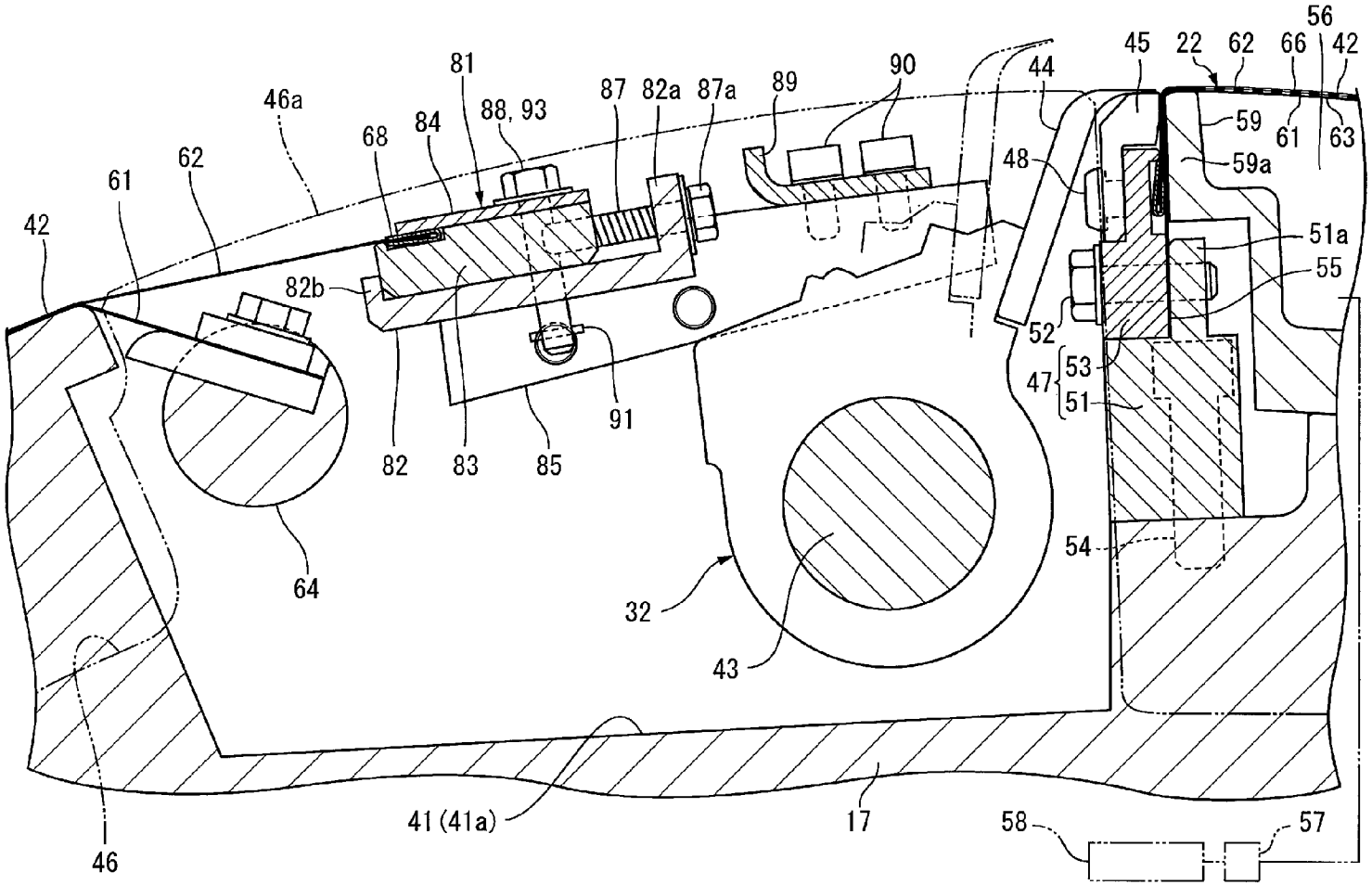
FIG. 2 is an enlarged sectional view showing a gap formed in an outer surface of a printing cylinder.

As shown in FIG. 2, each gripper device 32 of the printing cylinder 17 is formed by a gripper shaft 43, a gripper member 44 disposed in the gripper shaft 43, a gripper receiving portion 49 for gripping the sheet 4 together with the gripper member 44, and the like. The gripper shaft 43, gripper member 44, and gripper receiving portion 49 are disposed in the gap 41 formed in the outer surface of the printing cylinder 17.

The gripper shaft 43 extends from one end portion of the printing cylinder 17 to the other end portion in the axial direction in parallel to the axis (rotation axis) of the printing cylinder 17, and is rotatably supported by support plate members 46*a* of support plates 46 (see FIG. 9) attached to the two end portions of the printing cylinder 17. Each support plate member 46*a* is a portion which is formed in the outer portion of the support plate 46 to protrude outward in the radial direction, and is disposed at each of three positions, in the circumferential direction, corresponding to the gaps 41. Each support plate member 46*a* is formed in a shape to cover the corresponding gap 41 from the outside of the printing cylinder 17 in the axial direction. The gripper shaft 43 is driven by a conventionally well-known cam mechanism (not shown), and pivots at a predetermined time.

The gripper member 44 is disposed at each of a plurality of positions in the axial direction of the corresponding gripper shaft 43. The gripper member 44 moves between a gripping position indicated by solid lines in FIG. 2 and a release position indicated by two-dot dashed lines in FIG. 2 when the gripper shaft 43 pivots. In this embodiment, the gripper member 44 forms a "gripper" according to the present invention.

The gripper receiving portion 49 includes a gripper pad 45 for sandwiching the sheet 4 in cooperation with the gripper member 44, and a gripper pad shaft 47 for detachably holding the gripper pad 45. The gripper pad 45 is fixed by a fixing bolt 48 while it is placed on the distal end portion of the gripper pad shaft 47 attached to the gap 41. In this embodiment, the gripper pad shaft 47 is formed by a support member 51 which protrudes outward in the radial direction of the printing cylinder 17 from the bottom of the gap 41, and a holding member 53 which is fixed by a fixing bolt 52 while it is overlaid on a protruded end portion 51*a* of the support member 51. The support member 51 and the holding member 53 extend from one end portion of the printing cylinder 17 to the other end portion in the axial direction in parallel to the axis of the printing cylinder 17. The support member 51 is fixed to the bottom of the gap 41 by a fixing bolt 54. An abutting surface 55 between the holding member 53 and the protruded end portion 51*a* of the support member 51 extends in the radial and axial directions of the printing cylinder 17.

As shown in FIG. 2, a suction chamber 56 serving as part of the sucking device 22 is formed in each of the three sheet support portions 42 of the printing cylinder 17. The sucking device 22 sucks, toward the outer surface of the printing cylinder 17, the sheet 4 conveyed by the printing cylinder 17. The sucking device 22 includes the suction chamber 56, and an air suction device 58 connected to the suction chamber 56 via an opening/closing valve 57. The suction chamber 56 is formed in a box-shaped member 59 disposed in the outer portion of the printing cylinder 17. The box-shaped member 59 opens outward in the radial direction of the printing cylinder 17. The opening portion of the box-shaped member 59 is covered with a metal sheet 61 and a non-metal sheet 62.

The metal sheet 61 is obtained by forming a number (a plurality) of ventilation holes 63 in a sheet made of stainless steel or the like. The metal sheet 61 is formed in a shape to cover the entire region of each sheet support portion 42, and the two end portions of the metal sheet 61 are fixed to the printing cylinder 17. The two end portions indicate the upstream and downstream end portions in the sheet convey direction. The downstream end portion of the metal sheet 61 in the sheet convey direction is folded inside in the radial direction of the printing cylinder 17 along an end portion 59*a* of the box-shaped member 59 in the gap 41 (41*a*) shown in FIG. 2, and sandwiched by the holding member 53 and the protruded end portion 51*a* of the support member 51, which have been described above. The upstream end portion of the metal sheet 61 is fixed to a sheet holding shaft 64 disposed in the gap 41 (41*b*) separated from the gap 41 (41*a*) shown in FIG. 2 on the upstream side in the sheet convey direction. The sheet holding shaft 64 shown in FIG. 2 supports the end portion of the metal sheet 61 covering the sheet support portion 42 between the gap 41 (41*a*) and the gap 41 (41*c*) separated on the downstream side.

Figure 7:
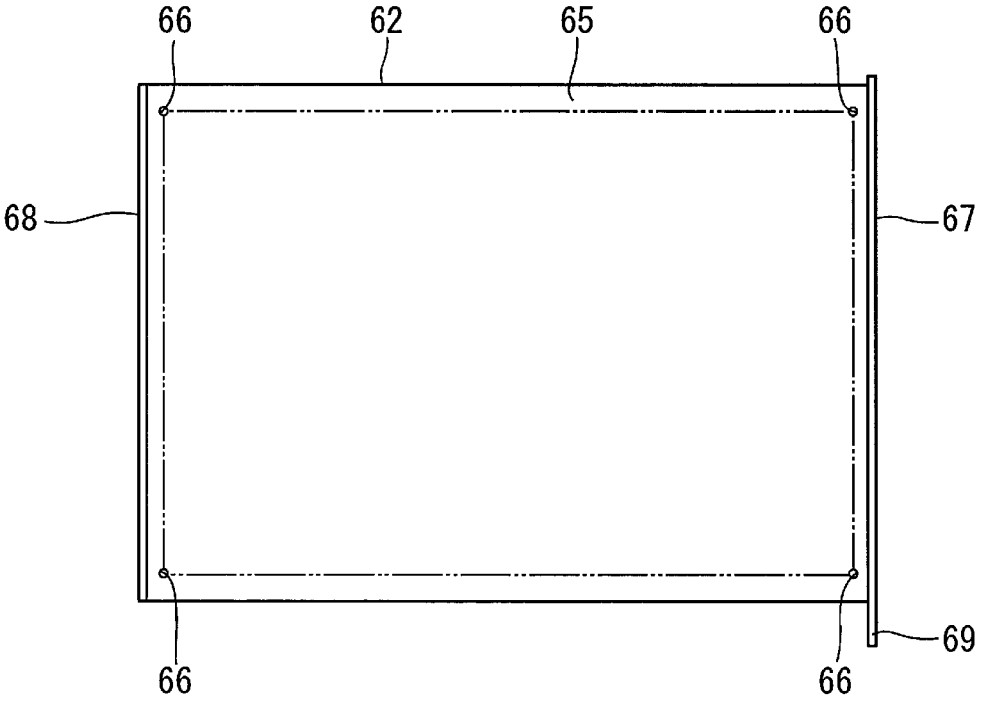
FIG. 7 is a plan view showing a non-metal sheet.
Figure 8:
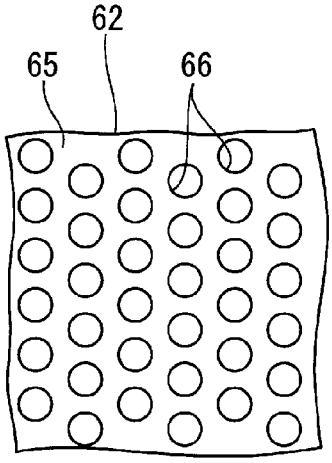
FIG. 8 is an enlarged plan view showing part of the non-metal sheet.

The non-metal sheet 62 serves as a protection sheet forming a "sheet-like member" according to the present invention. This non-metal sheet 62 includes a main body 65 formed in a sheet-like shape using a non-metal material, and a number (a plurality) of ventilation portions 66 through which air passes in the thickness direction of the main body 65, as shown in FIGS. 7 and 8. The main body 65 is made of a material which has high heat resistance, UV resistance, and solvent resistance while having strength so as not to stretch due to heat and an appropriate tensile strength. The material used to form the main body 65 according to this embodiment is PFA (tetrafluoroethylene-perfluoroalkyl vinyl ether copolymer). The thickness of the main body 65 desirably falls within the range of 0.07 mm (inclusive) to 0.5 mm (inclusive) and, more specifically, the range of 0.1 mm to 0.3 mm.

Figure 3:
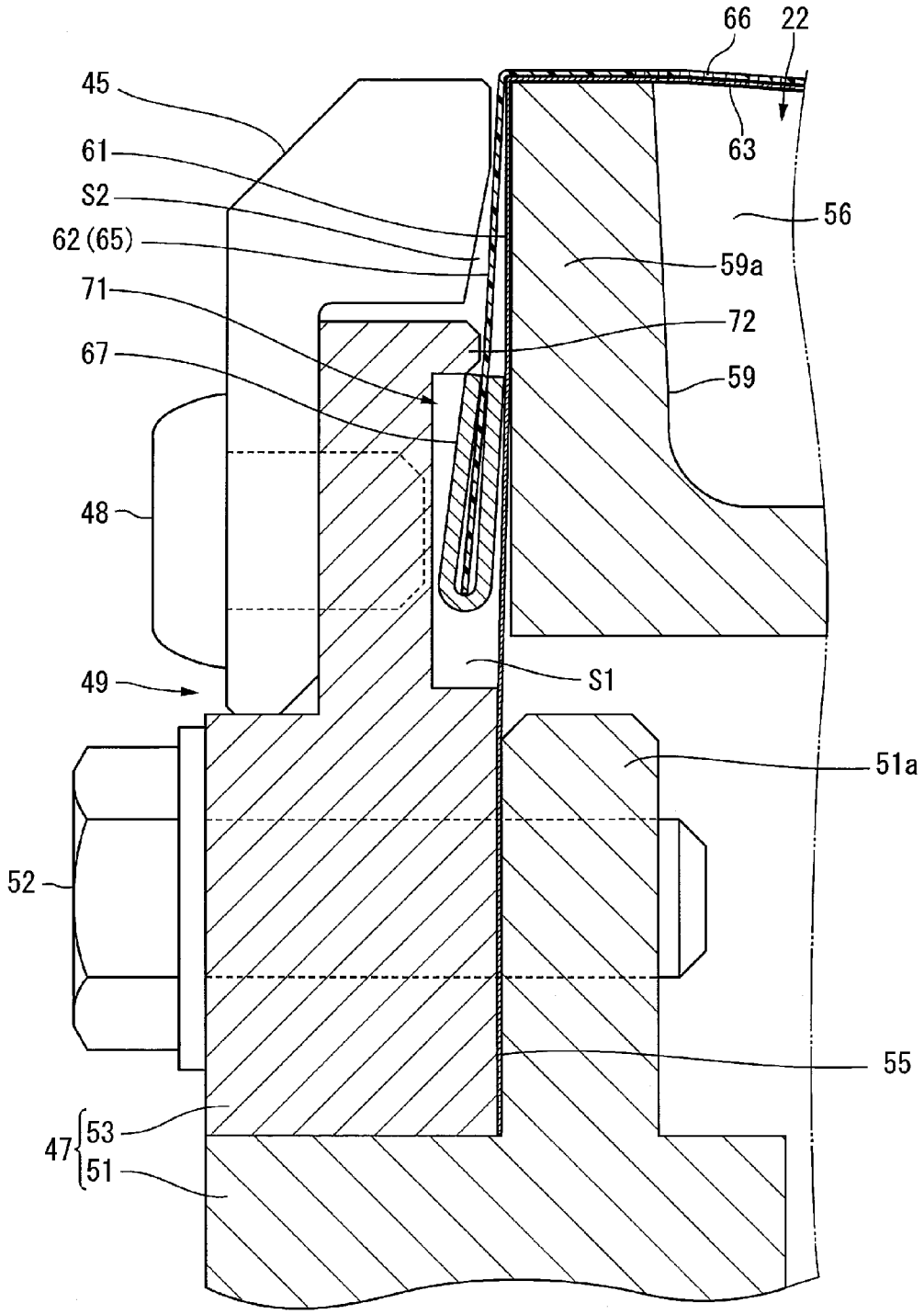
FIG. 3 is an enlarged sectional view showing a main part.

Bases 67 and 68 are disposed in the two end portions of the main body 65. The two end portions indicate those in the right-and-left direction in FIG. 7 and, more precisely, the downstream end portion (one end portion) and the upstream end portion (the other end portion) in the sheet convey direction. The base 67 positioned in the downstream end portion of the main body 65 in the sheet convey direction will be referred to as the first base 67 hereinafter, and the base 68 positioned in the upstream end portion will be referred to as the second base 68 hereinafter. As shown in FIG. 3, each of the first base 67 and the second base 68 is formed to have a thickness larger than that of the main body 65 of the non-metal sheet 62, and extends from one end of the non-metal sheet 62 to the other end in the axial direction of the printing cylinder 17. As shown in FIG. 7, a handle 69 protruding from one end of the printing cylinder 17 in the axial direction is formed in the first base 67. In this embodiment, the first base 67 forms a "locking piece" according to the present invention.

Each ventilation portion 66 is formed by a through hole which extends through the main body 65 in the thickness direction. The opening shape of each ventilation portion 66 is a circle, as shown in FIG. 8. The adjacent ventilation portions 66 are not connected. The ventilation portions 66 are formed in the main body 65 in the axial direction of the printing cylinder 17 and in the sheet convey direction at predetermined intervals. In this embodiment, as indicated by two-dot dashed lines in FIG. 7, the ventilation portions 66 are formed over almost the entire region of the main body 65. The diameter of each ventilation portion 66 desirably falls within the range of 0.2 mm (inclusive) to 1 mm (inclusive) and, more specifically, the range of 0.3 mm to 0.9 mm. The formation pitch of the ventilation portions 66 is desirably equal to or smaller than 1.3 mm and, more specifically, falls within the range of 0.5 mm to 1.1 mm. Furthermore, a porosity preferably falls within the range of 50% (inclusive) to 70% (inclusive). The porosity indicates the ratio of the opening area of all the ventilation portions 66 to the total area of the main body 65.

The thus formed non-metal sheet 62 is attached to the printing cylinder 17 by a sheet-like member holding device 70 (see FIG. 2) while it is overlaid on the above-described metal sheet 61 (the outer surface of the printing cylinder 17). The sheet-like member holding device 70 includes a first holding unit 71 for holding the first base 67 disposed in one end portion of the non-metal sheet 62, and a second holding unit 81 for holding the second base 68 disposed in the other end portion of the non-metal sheet 62. As shown in FIG. 3, the first holding unit 71 is disposed between the gripper receiving portion 49 and the end portion 59*a* of the box-shaped member 59. As shown in FIG. 2, the end portion 59*a* of the box-shaped member 59 forms a side wall which extends in the radial direction of the printing cylinder 17 on the upstream side in the sheet convey direction in the gap 41.

As shown in FIG. 3, the first holding unit 71 includes a space S1 in which the first base 67 is inserted while the non-metal sheet 62 extends inward in the radial direction of the printing cylinder 17 from the outer surface side of the printing cylinder 17. The first holding unit 71 also includes an abutment wall 72 which opposes, from the outside (the upper side in FIG. 3) in the radial direction of the printing cylinder 17, the first base 67 inserted in the space S1. In this embodiment, the abutment wall 72 is formed in the holding member 53 of the gripper pad shaft 47. In this case, a concave portion where the space S1 is formed exists in the surface, opposing the box-shaped member 59, of the holding member 53. The upper end portion of the concave portion serves as the abutment wall 72. Since the first base 67 positioned in the first holding unit 71 opposes the abutment wall 72, it cannot move to the outside in the radial direction of the printing cylinder 17. In other words, the abutment wall 72 restricts the movement of the first base 67 to the outside in the radial direction of the printing cylinder 17.

Figure 9:
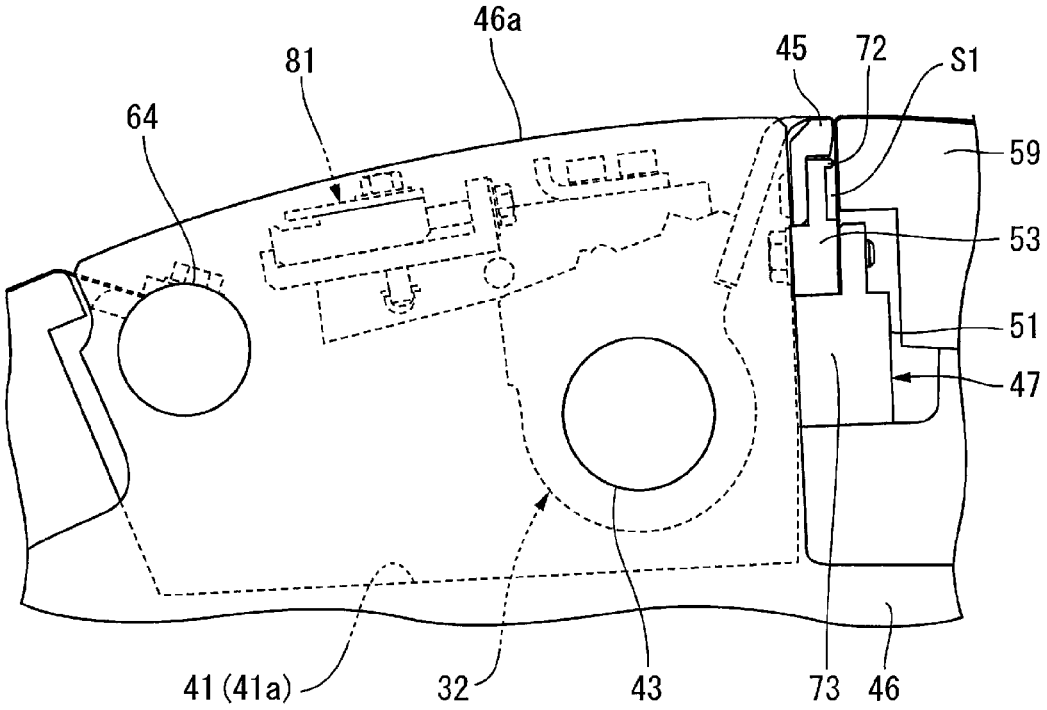
FIG. 9 is a side view showing part of an end portion of the printing cylinder in the axial direction.

As shown in FIG. 9, the space S1 and a space S2 between the 25 gripper pad 45 and the end portion 59*a* of the box-shaped member 59 communicates with a release portion 73 formed in the end portion of the printing cylinder 17 in the axial direction. The release portion 73 is formed on the upstream side (the right side in FIG. 9) of the support plate member 46*a* of the support plate 46 in the sheet convey direction, and opens in the axial direction of the printing cylinder 17. Therefore, the end portions of the spaces S1 and S2 in the axial direction of the printing cylinder 17 are released to the outside. The spaces S1 and S2 can be visually perceived by seeing the printing cylinder 17 from the axial direction.

The second base 68 disposed in the other end portion of the non-metal sheet 62 is held by the second holding unit 81. The second holding unit 81 is disposed in the gap 41 (41*b*) separated, on the upstream side in the sheet convey direction, from the gap 41 (41*a*) where the first holding unit 71 for holding the first base 67 is disposed. The second holding unit 81 in the gap 41 (41*b*) has the same structure as that of the second holding unit 81 in the gap 41 (41*a*) shown in FIG. 2. That is, the second holding unit 81 includes a guide member 82 extending in the axial direction of the printing cylinder 17 in the gap 41, a slider 83 movably supported by the guide member 82, and a cover plate 84 for sandwiching the second base 68 in cooperation with the slider 83.

The guide member 82 extends from one end portion of the printing cylinder 17 to the other end portion in the axial direction, and is formed to have a groove-shaped cross-section with a pair of ribs 82*a* and 82*b*. The rib 82*a* is provided in the downstream end portion of the guide member 82 in the sheet convey direction, and the rib 82*b* is provided in the upstream end portion of the guide member 82 in the sheet convey direction. The guide member 82 is fixed, by a support bracket 85 and fixing bolts 86 (see FIG. 4), to the support plates 46 provided in the two end portions of the printing cylinder 17 in the axial direction.

The slider 83 is formed in a plate shape extending in the axial direction of the printing cylinder 17 along the guide member 82. The slider 83 is attached to the guide member 82 by two kinds of bolts. The two kinds of bolts are an adjusting bolt 87 extending in the sheet convey direction and a fixing bolt 88 extending in the radial direction of the printing cylinder 17.

The adjusting bolt 87 rotatably extends through the rib 82*a* of the guide member 82, and is threadably engaged with the slider 83. The adjusting bolt 87 positions the slider 83 in the sheet convey direction with reference to the guide member 82. In this embodiment, the adjusting bolt 87 forms the "second bolt" according to the present invention.

In this embodiment, a stopper 89 (see FIG. 2) is disposed at a position opposing a head 87*a* of the adjusting bolt 87, that is, on the upstream side of the guide member 82 in the sheet convey direction. The stopper 89 extends in the axial direction of the printing cylinder 17 along the guide member 82, and is fixed to the above-described support bracket 85 by fixing bolts 90. Therefore, the adjusting bolt 87 can be loosened until the head 87*a* abuts against the stopper 89, and cannot be loosened any more after the head 87*a* abuts against the stopper 89. This stopper 89 forms a "loosening prevention member" according to the present invention.

Figure 5:
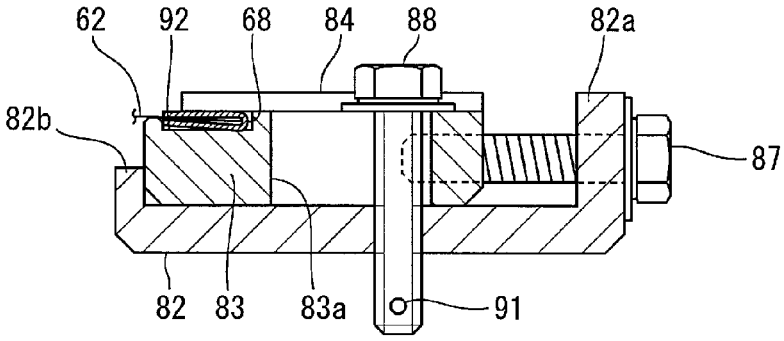
FIG. 5 is a sectional view taken along a line V-V in FIG. 4.

As shown in FIG. 5, the fixing bolt 88 extends through an elongated hole 83*a* of the slider 83, and is threadably engaged with the guide member 82. The fixing bolt 88 is arranged in each of the two end portions and central portion of the slider 83. The fixing bolts 88 fix the slider 83 to the guide member 82. The distal end portion of each fixing bolt 88 is provided with a removal prevention pin 91 extending to intersect the fixing bolt 88. The fixing bolt 88 forms the "third bolt" according to the present invention, and the removal prevention pin 91 forms a "removal prevention member" according to the present invention.

Figure 4:
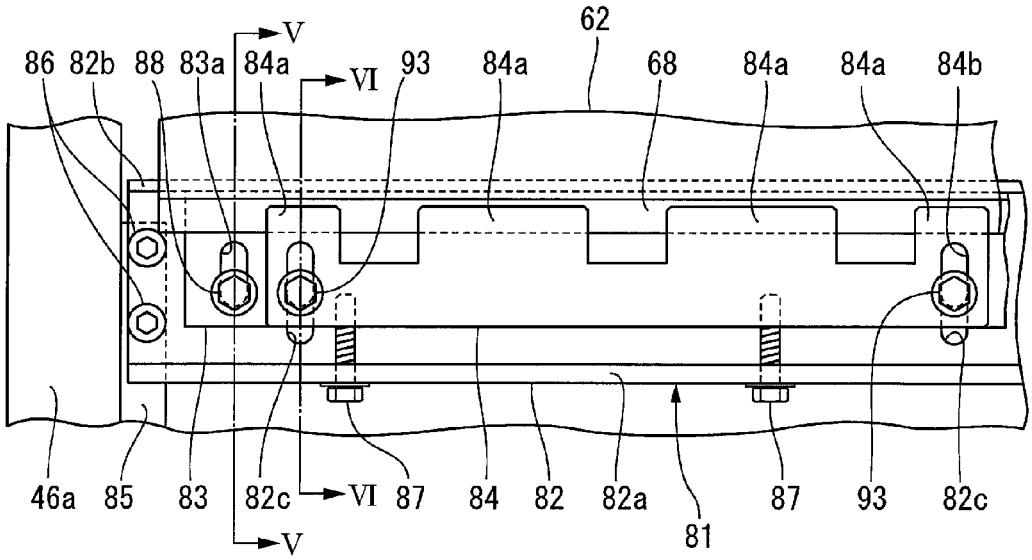
FIG. 4 is a plan view showing part of the printing cylinder.
Figure 6:
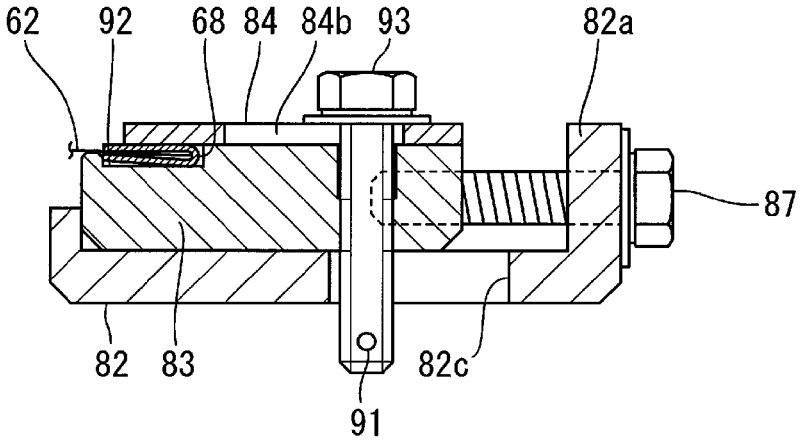
FIG. 6 is a sectional view taken along a line VI-VI in FIG. 4.

As shown in FIG. 6, a concave groove 92 in which the second base 68 is formed in the downstream end portion of the slider 83 in the sheet convey direction. As shown in FIG. 4, the cover plate 84 is formed in a band plate shape extending in the axial direction of the printing cylinder 17. A plurality of press portions 84*a* for pressing the second base 68 are formed in the cover plate 84. In this embodiment, a plurality of cover plates 84 arrayed in the axial direction of the printing cylinder 17 are arranged. These cover plates 84 form a "plate" according to the present invention.

Each cover plate 84 is fixed to the slider 83 by fixing bolts 93 in the two end portions in the longitudinal direction while it is overlaid on the slider 83. As shown in FIG. 6, each fixing bolt 93 is threadably engaged with the slider 83 by extending through an elongated hole 84*b* of the cover plate 84. The distal end portion of the fixing bolt 93 is inserted through an elongated hole 82*c* of the guide member 82. The removal prevention pin 91 extending to intersect the fixing bolt 93 is also provided in the distal end portion of the fixing bolt 93. This fixing bolt 93 forms the "first bolt" according to the present invention.

A procedure of attaching the non-metal sheet 62 to the printing cylinder 17 will now be described. To attach the non-metal sheet 62 to the printing cylinder 17, one end portion of the first base 67 in the longitudinal direction is inserted from the outside of the printing cylinder 17 in the axial direction to the release portion 73 formed in one end portion of the printing cylinder 17 in the axial direction. This attachment operation and an operation of detaching the non-metal sheet 62 from the printing cylinder 17 can be readily performed by gripping the handle 69. The first base 67 is further moved in the axial direction, and is inserted to the space S1 of the first holding unit 71.

If the non-metal sheet 62 is pulled to the other end portion side while one end portion of the non-metal sheet 62 is inserted to the space S1, the first base 67 abuts against the abutment wall 72, and cannot move any more. Thus, when one end portion of the non-metal sheet 62 is inserted to the above-described space S1, the non-metal sheet 62 is held by the first holding unit 71 (printing cylinder 17) while one end portion of the non-metal sheet 62 is prevented from being removed.

After that, the main body 65 of the non-metal sheet 62 is overlaid on the sheet support portion 42 of the printing cylinder 17. The second base 68 is sandwiched by the cover plate 84 and the slider 83 of the second holding unit 81, thereby fixing the cover plate 84 to the slider 83 by the fixing bolts 93.

The adjusting bolt 87 is tightened to pull the non-metal sheet 62 together with the slider 83. When the non-metal sheet 62 is pulled, it is brought into tight contact with the metal sheet 61 (the outer surface of the printing cylinder 17). After that, while a predetermined tension acts on the non-metal sheet 62, the slider 83 is fixed to the guide member 82 using the fixing bolts 88. By fixing the slider 83 to the guide member 82, the operation of attaching the non-metal sheet 62 to the printing cylinder 17 is completed.

To detach the non-metal sheet 62 from the printing cylinder 17, the second base 68 is detached from the second holding unit 81 first. The main body 65 is removed from the sheet support portion 42 of the printing cylinder 17, and the handle 69 of the first base 67 is gripped and pulled in the axial direction of the printing cylinder 17. By pulling the handle 69, one end portion of the non-metal sheet 62 including the first base 67 is pulled outward in the axial direction of the printing cylinder 17 from the first holding unit 71 through the release portion 73 of the printing cylinder 17.

An operation of attaching the non-metal sheet 62 to the printing cylinder 17 and an operation of detaching the non-metal sheet 62 from the printing cylinder 17 can be performed regardless of the gripper member 44 and gripper pad 45 of the gripper device 32. Therefore, according to this embodiment, it is possible to provide the sheet-like member holding device of the printing press, which can attach and detach the non-metal sheet 62 by a simple method without moving the gripper member 44 or gripper pad 45.

The first base 67 of the non-metal sheet 62 according to this embodiment extends from one end of the printing cylinder 17 to the other end in the axial direction in the non-metal sheet 62. The handle 69 is formed in one end portion of the first base 67 in the axial direction, as described above. Therefore, according to this embodiment, it is possible to readily attach and detach the non-metal sheet 62 by gripping the handle 69.

The second holding unit 81 according to this embodiment includes the pins 91 for preventing removal of the fixing bolts 88 and 93, and the stopper 89, opposing the head 87*a* of the adjusting bolt 87, for preventing loosening of the adjusting bolt 87. Therefore, according to this embodiment, it is possible to reliably prevent the adjusting bolt 87 and the fixing bolts 88 and 93 of the second holding unit 81 from loosening and falling while the printing cylinder 17 rotates.

The above-described embodiment has exemplified an example in which the abutment wall 72 for restricting the movement of the first base 67 is formed in the holding member 53 of the gripper pad shaft 47. However, the abutment wall 72 may be formed in a portion opposing the holding member 53 in the end portion 59*a* of the box-shaped member 59. In this case, a concave portion where the space S1 is formed exists in the surface, opposing the holding member 53, of the end portion 59*a* of the box-shaped member 59. The upper end portion of the concave portion serves as the abutment wall 72. By forming the abutment wall 72 in at least one of the holding member 53 and the end portion 59*a* of the box-shaped member 59, the movement of the first base 67 to the outside in the radial direction of the printing cylinder 17 is restricted even if the gripper pad 45 is detached from the gripper pad shaft 47.

The above-described embodiment has exemplified the sheet-like member holding device 70 for holding the non-metal sheet 62 as the protection sheet of the printing cylinder 17. However, the sheet-like member holding device according to the present invention can hold a sheet-like member different from the protection sheet of the printing cylinder 17. For example, the sheet-like member holding device according to the present invention can be used to hold a sheet-like member such as a paper or film on a cylinder such as an impression cylinder or transfer cylinder having a function of conveying a printing product. The paper or film is used to prevent the blanket of a blanket cylinder or printing material from being stained or being damaged from rubbing.

Furthermore, the sheet-like member holding device according to the present invention can hold a packing sheet as a sheet-like member formed from paper, cloth, rubber, or the like, and a rubber sheet for protecting the packing sheet on the surface of the impression cylinder. The packing sheet is used to adjust the printing pressure so as to improve the contact between the plate surface of a plate cylinder and a printing sheet by applying an appropriate elastic force to the metal surface of an impression cylinder in order to avoid the impact between the metal surface of the impression cylinder and the plate surface of the plate cylinder at the time of printing in an intaglio printing press, a relief printing press, or the like.

What is claimed is:

1. A sheet-like member holding device of a printing press, comprising:

a gripper receiving portion disposed in a gap formed in an outer surface of a cylinder, and configured to grip a sheet as a printing product together with a gripper;

a first holding unit disposed between the gripper receiving portion and a side wall extending in a radiation direction of the cylinder on an upstream side in a sheet convey direction in the gap, and configured to hold one end portion of a main body of a sheet-like member overlaid on the outer surface of the cylinder; and a second holding unit configured to hold the other end portion of the main body of the sheet-like member, wherein the sheet-like member includes, at the one end portion of the main body, a locking piece formed to have a thickness larger than that of the main body, the first holding unit includes a space in which the one end portion of the main body of the sheet-like member is inserted while the sheet-like member extends inward in the radial direction of the cylinder from an outer surface side of the cylinder, and an abutment wall opposing the locking piece of the one end portion inserted in the space from the outside in the radial direction of the cylinder, and configured to restrict movement of the locking piece to the outside in the radial direction, and an end portion of the space in an axial direction of the cylinder is open to the outside of the cylinder toward the axial direction.

2. The device according to claim 1, wherein the locking piece extends from one end to the other end of the sheet-like member in the axial direction, and the locking piece includes a handle formed in one end portion in the axial direction.

3. The device according to claim 1, wherein the gripper receiving portion includes a gripper pad configured to sandwich the sheet in cooperation with the gripper, and a gripper pad shaft configured to detachably hold the gripper pad, and the abutment wall is configured to restrict the movement of the locking piece even if the gripper pad is detached from the gripper pad shaft.

4. The device according to claim 1, wherein the second holding unit includes a slider and a plate configured to sandwich the other end portion of the main body of the sheet-like member, a first bolt configured to fix the plate to the slider, a guide member configured to movably support the slider, a second bolt configured to determine a position of the slider with respect to the guide member, a third bolt configured to fix the slider to the guide member, and a loosening prevention member configured to prevent loosening of the second bolt.

5. The device according to claim 4, wherein the second holding unit further includes a removal prevention member configured to prevent removal of the first bolt and the third bolt.

6. The device according to claim 1, wherein the second holding unit is disposed in another gap separated from the gap in a circumferential direction of the cylinder.

* * * * *